US005918945A

United States Patent [19]

Martens et al.

[11] Patent Number: 5,918,945

[45] Date of Patent: Jul. 6, 1999

[54] FRICTION LOCK HANDLE

[75] Inventors: Harry Martens; David N. Wieler, both of Winnipeg, Canada

[73] Assignee: Palliser Furniture, Ltd., Winnipeg, Canada

[21] Appl. No.: 08/878,443

[22] Filed: Jun. 18, 1997

[51] Int. Cl.[6] ..... A47C 1/032

[52] U.S. Cl. ..... 297/463.1; 297/375

[58] Field of Search ..... 297/374, 375, 297/463.1; 16/111 R; D6/500; D8/300, 313, 317, 318

[56] References Cited

U.S. PATENT DOCUMENTS 1,477,507 12/1923 Lochner ..... 297/375 X
2,472,855 6/1949 Lorenz ..... 297/374 X
5,211,444 5/1993 Kjellman ..... 297/375

*Primary Examiner*—Peter R. Brown
*Attorney, Agent, or Firm*—Senniger, Powers, Leavitt & Roedel

[57] ABSTRACT

A handle of a friction lack comprises a body having a threaded portion extending along an axis for threadable connection to a bolt of the friction lock such that rotation of the body in a first sense advances the body on the bolt and rotation of the body in a second, opposite, sense withdraws the body from the bolt. The body extends along an axis which is transverse to the threaded portion axis. The body has a first end and an opposite second end lying on the transverse axis. A first ear extends from the first end and makes an angle with the transverse axis to cant toward the first sense of rotation and a second ear extending from the second end and making an angle with the transverse axis so as to also cant toward the first sense of rotation.

18 Claims, 4 Drawing Sheets

FRICTION LOCK HANDLE

FIELD OF THE INVENTION

This invention relates to a handle for a friction lock, and a chair adjustment mechanism and reclining chair incorporating such a lock.

BACKGROUND OF THE INVENTION

A number of chair adjustment mechanisms for reclining chairs are known. Some of these mechanism are complex and, therefore, costly to manufacture. Other simpler mechanisms may not be effective in retaining the chair in a position set by the user, or may have a short serviceable life.

This invention, therefore, seeks to provide a chair adjustment mechanism of simple constructions but having a long serviceable life.

SUMMARY OF THE INVENTION

According to the present invention, there is provided a handle for a friction lock, comprising a body having a threaded portion extending along an axis for threadable connection to a member of a friction lock such that rotation of said body in a first direction advances said body on said member and rotation of said body in a second, opposite, direction withdraws said body from said member, said body extending along an axis which is transverse to said threaded portion axis, said body having a generally elliptically shaped body portion with a major axis lying along said transverse axis, said body portion terminating at a first end and an opposite second end lying on said transverse axis, with a first ear extending from said first end and making an angle with said transverse axis so as to cant toward said first direction of rotation and a second ear extending from said second end and making an angle with said transverse axis so as to cant toward said first direction of rotation.

BRIEF DESCRIPTIONS OF THE DRAWINGS

In the figures which describe a preferred embodiment of the invention,

FIG. 1 is a perspective view of a reclining chair incorporating a friction lock made in accordance with an embodiment of the subject invention, FIG. 2 is a side view of a portion of FIG. 1, FIG. 3 is a side view of a like portion of the chair shown in FIG. 2 but in a reclined position, FIG. 4 is a cross-sectional view along the lines 4—4 of FIG. 1, FIG. 5 is a perspective view of a friction lock made in accordance with this invention, FIG. 6 is a front view of a handle portion of the friction lock of FIG. 5, and FIG. 7 is a side view of FIG. 6.

DETAILED DESCRIPTION OF THE PREFERRED EMBODIMENTS

Figure 1:
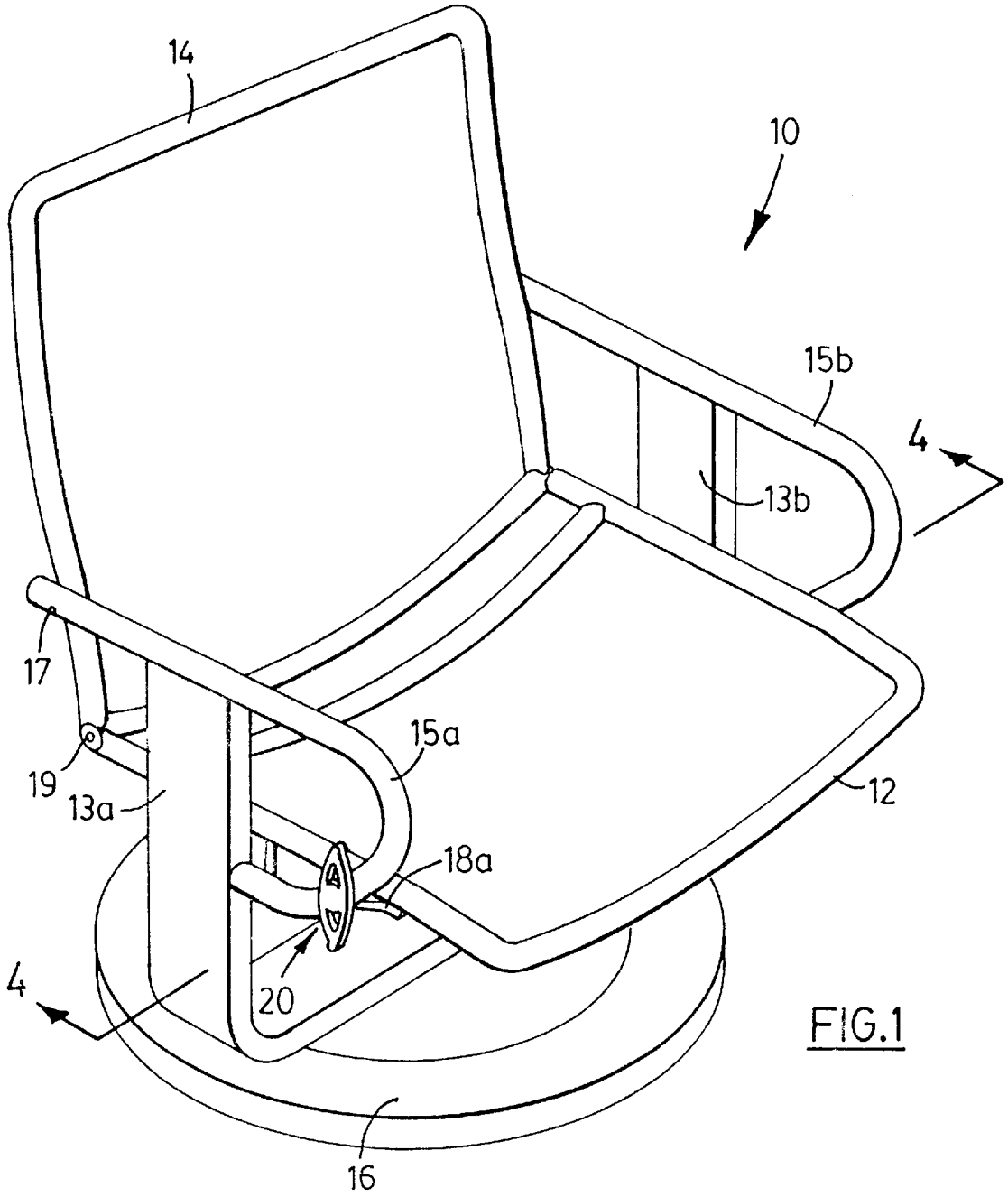
Figure 2:
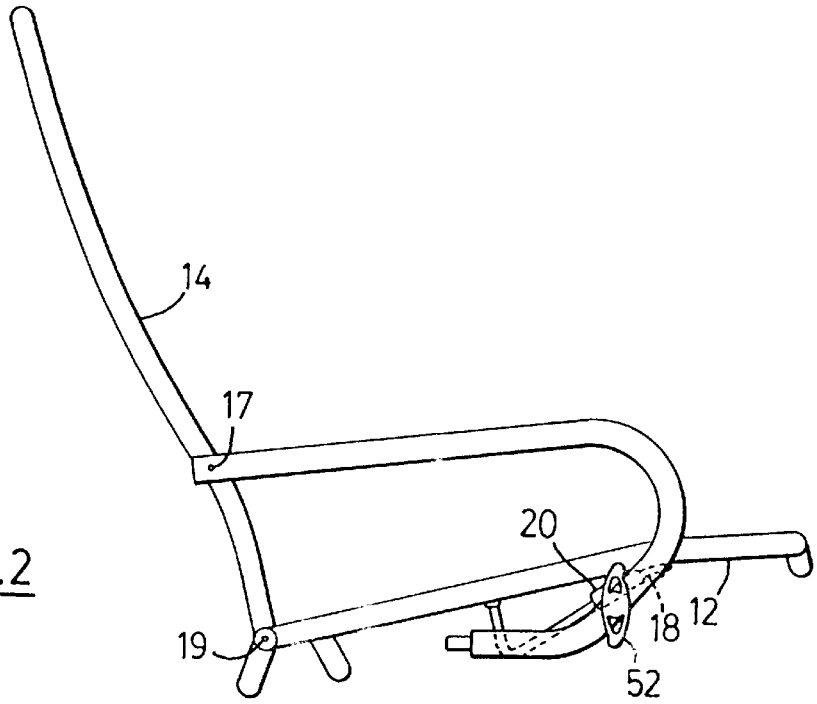
Figure 3:
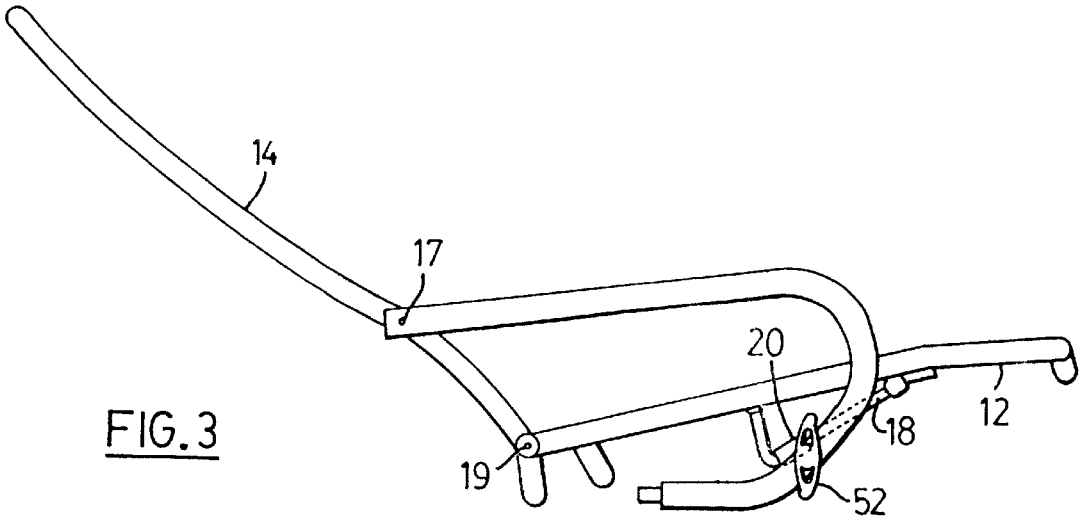

Turning to FIGS. 1 and 2, a chair 10 has a chair seat 12, a chair back 14, and a chair base 16. Posts 13*a*, 13*b* extend from the chair base. The chair back is hingeably connected to the chair seat by hinges 19. A rod 18*a*, 18*b* (not shown) is attached to the seat under each side thereof. Two chair arms 15*a*, 15*b* are hingedly connected by hinges 17 to the chair back; chair arm 15*a* is bolted to post 13*a* and joined to rod 18*a* by a friction lock indicated generally at 20; chair arm 15*b* is bolted to post 13*b* and joined to rod 18*b* by a sliding connection. With the friction lock released, the arms 15*a*, 15*b* are free to slide along the rods 18*a*, 18*b* so that the chair back 14 may pivot with respect to the chair seat in order to adjust the tilt of the back with respect to the seat. FIG. 3 illustrates the chair 10 in the fully reclined position. With the friction lock engaged, the arms are not free to slide along the rods and so the chair back is locked with respect to the chair seat.

Figure 4:
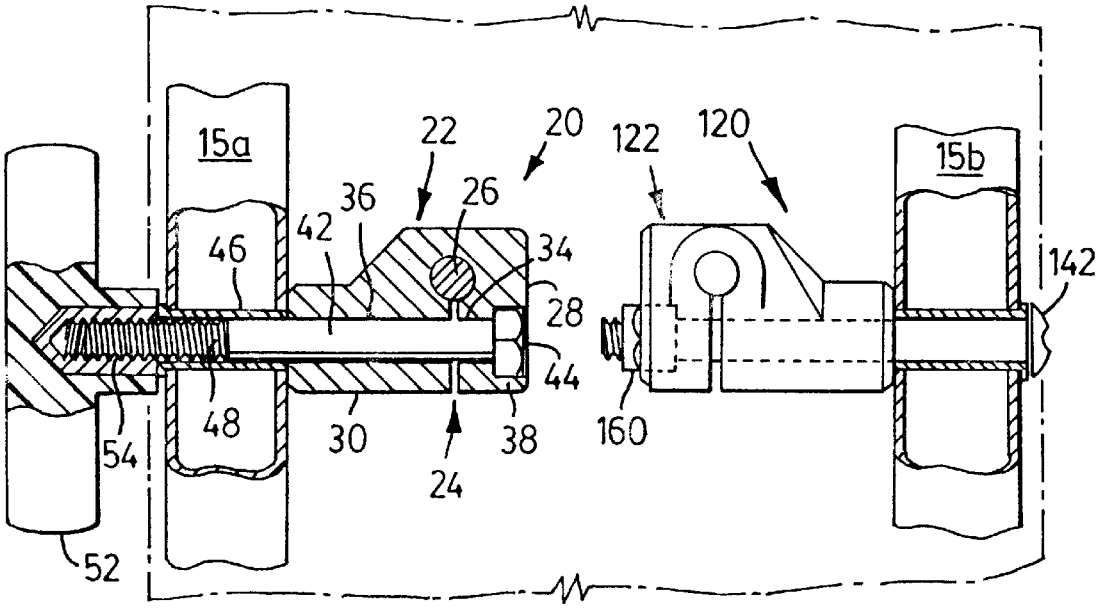
Figure 5:
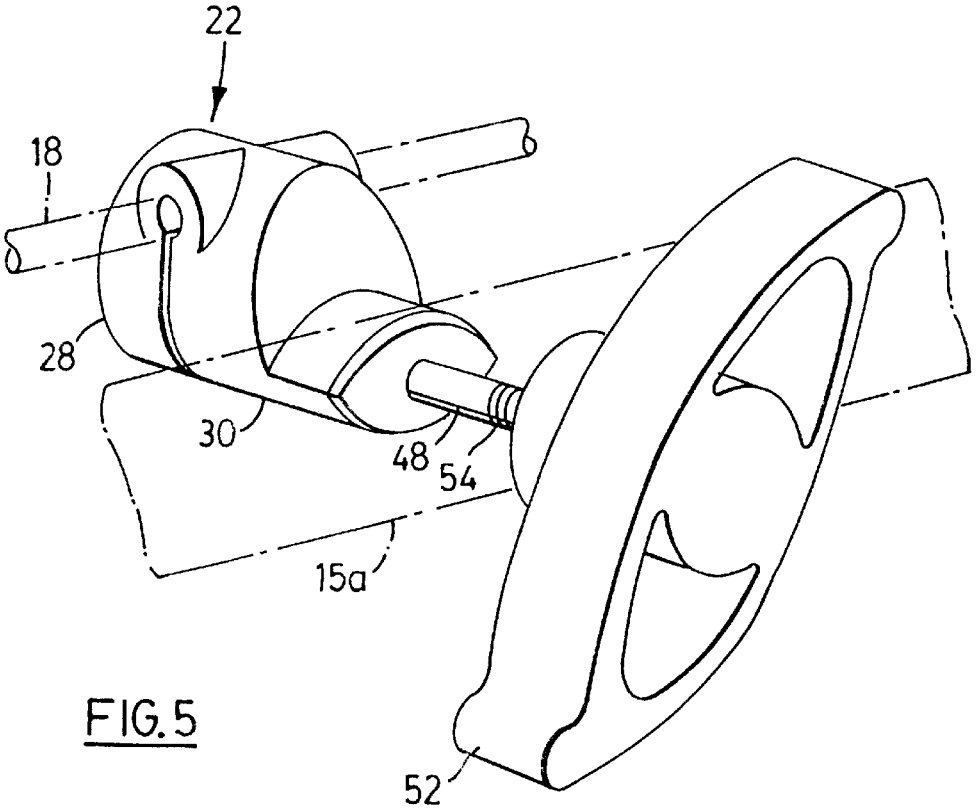

Referencing FIGS. 4 and 5, the friction lock 20 comprises a resilient hard plastic integrally formed clamp body 22. The clamp body is preferably formed of fibreglass reinforced nylon. The clamp body has a notch 24 therein extending to a channel 26. As is apparent from the figures, the channel 26 has a circular cross-section sized for receiving rod 18*a*. Notch 24 divides clamp body 22 into a first clamp portion 28 and a second clamp portion 30 on opposite sides of the notch. Aligned bores 34, 36 extend through the clamp body 22 transversely of the notch 24. Bore 34 has a multi-sided depression 38. An extension in the nature of bolt 42 extends through bore 34 and bore 36 such that the multi-sided head 44 of the bolt is received by the multi-sided depression 38 of bore 34. When the bolt is in this position, it is held against rotation by the multi-sided depression 38 and has a free end portion 48 extending past the second clamp portion 30. It will also be noted that bolt 42 extends on the notch side of rod receiving channel 26. The free end portion 48 of the bolt is received by a bushing 46 in an opening through arm 15*a* thereby connecting the bolt to the chair arm. A handle 52 is threaded to the threaded portion 54 of bolt 42.

Figure 7:
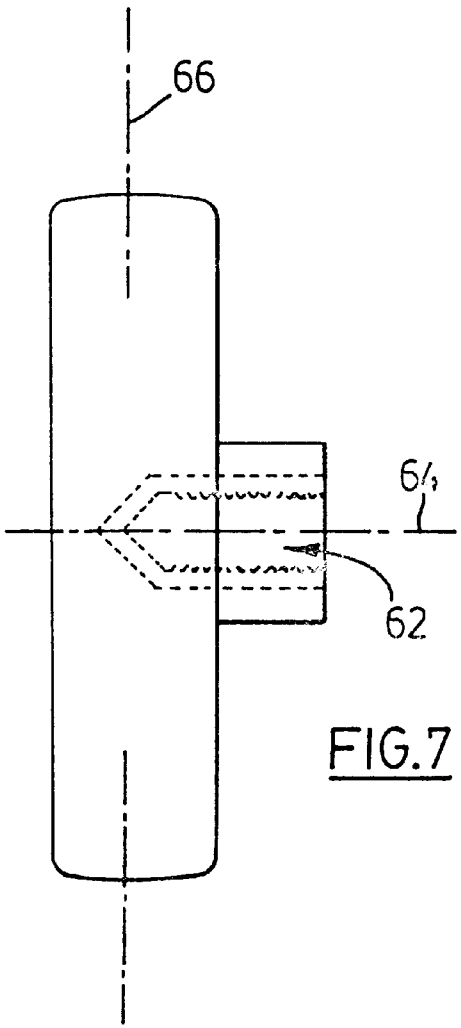
Figure 6:
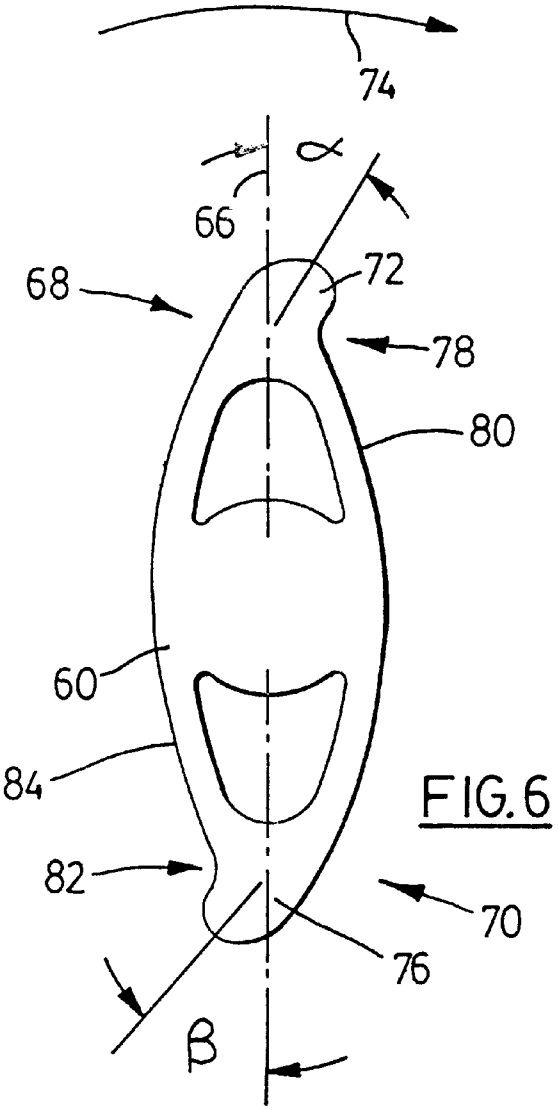

Referencing FIGS. 6 and 7, the handle 52 has a body 60 with an internally threaded portion 62 extending along an axis 64 for threadable connection to bolt 42 (FIG. 4). The body has a generally elliptical shape in plan view, with its major axis being axis 66 which is transverse to the axis 64. The body has a first end 68 and an opposite second end 70 lying on the transverse axis 66. A first ear 72 extends from the first end and makes an angle $\alpha$ with the transverse axis 66 so as to cant toward the direction of rotation 74 which advances the handle on bolt 42 (FIG. 4). A second ear 76 extends from said second end 70 and makes an angle $\beta$ with the transverse axis 66 so as to also cant toward the direction of rotation 74.

The angles $\alpha$ and $\beta$ are between 25 and 45 degrees and are preferably equal and about 32 degrees. A finger receiving notch 78 is formed between the body 60 and the first ear 72 on a side 80 of the body toward which the first ear cants and a finger receiving notch 82 is formed between the body and the second ear on a side 84 of the body toward which the second ear cants.

As is apparent from FIG. 2, handle 52 is below the level of the seat 12.

With the bolt connected to the chair arm and the rod 18*a* of the chair seat received in channel 26, if handle 52 is rotated to advance the handle on the bolt, flange 56 of the handle presses against arm 15*a* which, in turn, presses against the second clamp portion 30. This advance of the handle on bolt 42 also draws the first clamp portion 28 toward the second clamp portion as the head of the bolt 42 bears against the base of depression 38. Consequently, the handle acts to compress the second clamp portion toward the first clamp portion thereby narrowing notch 24 and reducing the size of the rod receiving channel 26. This clamps the rod to the clamp body in order to clamp the chair back in a set position.

If an occupant of the chair wishes to change the position of the chair back, he may turn the handle in a sense to withdraw it from the bolt thereby releasing the rod for slidable movement within the clamp body. With the handle withdrawn on bolt 42, the clamp body is not locked against rotation in a direction about the axis of the bolt. Consequently, the chair back may then be hinged about hinge 19. Once a desired new chair back setting has been achieved, the handle can then be once more advanced on the bolt to lock the chair back in this new position.

When the chair back is locked in a reclined position, a portion of the occupant's weight will press on the chair back and be transmitted through the arm 15*a* to bolt 42. This will result in a torsional force on bolt 42 which constitutes a binding force between the chair arm 15*a* and the flange 56 of the handle 52. This binding force must be overcome if the occupant wishes to change the reclining position of the chair while seated. Ears 72, 76 and finger notches 78, 82 allow the occupant to obtain a solid grip on handle 52 and provide a mechanical advantage when the occupant rotates the handle in a sense to withdraw the handle from the bolt thereby facilitating such rotation.

As seen in FIGS. 1 and 2, the opposite side of the chair back 14 has a chair back stabilising mechanism 120. Mechanism 120 comprises rod 18*b* (not shown) received by a clamp body 122 joined to arm 15*b* of the chair by bolt 142. It will be noted that bolt 142 receives locking nut 160. The locking nut is positioned on bolt 142 so that rod 118 is not clamped by the clamping body and so that the clamping body is able to rotate about the axis of the bolt.

As shown in FIG. 4, the chair arm 15*a* is tubular. The bushing 46 thus prevents the threads of bolt 42 from catching on the tubular wall of the arm as the bolt is drawn into the handle 52 by rotation of the handle.

In place of chair stabilising mechanism 120, optionally, the opposite side of the chair could be provided with a similar friction locking mechanism to that of friction locking mechanism 20.

Other modifications will be apparent to those skilled in the art and, therefore, the invention is defined in the claims.

What is claimed is:

1. A handle for a friction lock, comprising a body having a threaded portion extending along an axis for threadable connection to a member of a friction lock such that rotation of said body in a first direction advances said body on said member and rotation of said body in a second, opposite, direction withdraws said body from said member, said body extending along an axis which is transverse to said threaded portion axis, said body having a generally elliptically shaped body portion with a major axis lying along said transverse axis, said body portion terminating at a first end and an opposite second end lying on said transverse axis, with a first ear extending from said first end and making an angle with said transverse axis so as to cant toward said first direction of rotation and a second car extending from said second end and making an angle with said transverse axis so as to cant toward said first direction of rotation.

2. The handle of claim 1 wherein said angle said first ear makes with said transverse axis comprises between 25 and 45 degrees and wherein said angle said second ear makes with said transverse axis comprises between 25 and 45 degrees.

3. The handle of claim 2 wherein said angle said first ear makes with said transverse axis comprises about 32 degrees and wherein said angle said second ear makes with said transverse axis comprises about 32 degrees.

4. The handle of claim 3 including a finger receiving notch between said body portion and said first ear on a side of said body toward which said first ear cants and a finger receiving notch between said body portion and said second car on a side of said body toward which said second ear cants.

5. A chair adjustment mechanism comprising:

a clamp body having a rod receiving channel to define first and second clamp portions on opposite sides of a rod received by said channel;

an extension shaft extending from said first clamp portion through said second clamp portion to a free end portion, said extension shaft free end portion being threaded;

one of said clamp body and said shaft for connection to a structural member of a chair; and a handle threaded to said extension shaft for rotation in a first direction to compress said second clamp portion toward said first clamp portion in order to clamp a rod in said rod receiving channel and for rotation in a second direction to release said rod for sliding movement within said rod receiving channel, said handle comprising a handle body extending along an axis which is transverse to an axis of rotation of said handle body, said handle body having a generally elliptically shaped body portion with a major axis lying along said transverse axis, said handle body portion terminating at a first end and an opposite second end lying on said transverse axis, with a first ear extending from said first end and making an angle with said transverse axis so as to cant toward said first direction of rotation and a second ear extending from said second end and making an angle with said transverse axis so as to cant toward said first direction of rotation.

6. The mechanism of claim 5 wherein said angle said first ear makes with said transverse axis comprises between 25 and 45 degrees and wherein said angle said second ear makes with said transverse axis comprises between 25 and 45 degrees.

7. The mechanism of claim 6 wherein said angle said first ear makes with said transverse axis comprises about 32 degrees and wherein said angle said second ear makes with said transverse axis comprises about 32 degrees.

8. The mechanism of claim 7 including a finger receiving notch between said handle body portion and said first ear on a side of said handle body toward which said first ear cants and a finger receiving notch between said handle body portion and said second ear on a side of said handle body toward which said second ear cants.

9. The mechanism of claim 8 wherein said clamp body is integrally formed and resilient and has a notch extending to said rod receiving channel such that said first and second clamp portions are on opposite sides of said notch and wherein said extension shaft extends from said first clamp portion and through said second clamp portion on the notch side of said channel.

10. The mechanism of claim 9 wherein said second clamp portion has a bore extending therethrough transversely of said notch and wherein said extension shaft extends through said second clamp portion bore.

11. The mechanism of claim 10 wherein said extension shaft comprises a bolt.

12. The mechanism of claim 11 wherein said bolt has a multi-sided head and wherein said first clamp portion has a corresponding multi-sided depression extending into said first clamp portion from an end of said first clamp portion opposite said second clamp portion, said multi-sided depression for receiving said bolt head such that said bolt is restrained from rotation.

13. A reclining chair comprising:

a chair seat having a rod extending therefrom below said seat;

a chair back hinged to said seat;

a chair arm extending from said chair back, a portion of said chair arm extending below a plane of said chair seat;

a clamp body receiving said rod in a rod receiving channel, said clamp body having first and second clamp portions on opposite sides of said rod;

an extension shaft extending below said seat from said first clamp portion through said second clamp portion, and through said chair arm portion to a free end portion below said scat, said free end portion being threaded;

a handle threaded to said extension shaft for rotation in a first direction to press against said chair arm to compress said second clamp portion toward said first clamp portion in order to clamp a rod in said rod receiving channel and for rotation in a second direction to release said rod for sliding movement within said rod receiving channel, said handle comprising a handle body extending along an axis which is transverse to an axis of rotation of said handle body, said handle body having a first end and an opposite second end lying on said transverse axis, with a first ear extending from said first end and making an angle with said transverse axis so as to cant toward said first direction of rotation and a second ear extending from said second end and making an angle with said transverse axis so as to cant toward said first direction of rotation.

14. The chair of claim 13 wherein said chair arm is pivotally joined to said chair back.

15. The chair of claim 14 wherein said angle said first ear makes with said transverse axis comprises about 32 degrees and wherein said angle said second ear makes with said transverse axis comprises about 32 degrees.

16. The chair of claim 15 including a finger receiving notch between said handle body and said first ear on a side of said handle body toward which said first ear cants and a finger receiving notch between said handle body and said second ear on a side of said handle body toward which said second ear cants.

17. The chair of claim 16 wherein said chair arm is tubular and including a bushing extending through said chair arm and affixed thereto through which said extension extends.

18. The chair of claim 16 said handle body has a generally elliptical shape with a major axis lying along said transverse axis.

* * * * *

UNITED STATES PATENT AND TRADEMARK OFFICE

CERTIFICATE OF CORRECTION

PATENT NO. : 5,918,945

DATED : JULY 6, 1999

INVENTOR(S) : MARTENS, Harry, et al.

It is certified that error appears in the above-identified patent and that said Letters Patent is hereby corrected as shown below:

Claim 1, column 3, line 54, cancel "car" and insert --ear--;

Claim 1, column 4, line 2, cancel "car" and insert --ear--;

Claim 13, column 5, line 12, cancel "scat" and insert --seat--.

Signed and Sealed this

Twenty-ninth Day of February, 2000

*Attest:*

Q. TODD DICKINSON

*Attesting Officer*

*Commissioner of Patents and Trademarks*